United States Patent [19]

Schabert

[11] Patent Number: 4,883,414

[45] Date of Patent: Nov. 28, 1989

[54] ROTATING PISTON COMPRESSOR

[75] Inventor: Hans-Peter Schabert, Erlangen, Fed. Rep. of Germany

[73] Assignee: Siemens Aktiengesellschaft, Munich, Fed. Rep. of Germany

[21] Appl. No.: 171,653

[22] Filed: Mar. 22, 1988

[30] Foreign Application Priority Data

Mar. 23, 1987 [DE] Fed. Rep. of Germany ..... 3709493
Aug. 19, 1987 [DE] Fed. Rep. of Germany ..... 3727697

[51] Int. Cl.[4] ..... F04C 18/356; F04C 27/00
[52] U.S. Cl. ..... 418/57; 418/156
[58] Field of Search ..... 418/57, 63, 156

[56] References Cited

U.S. PATENT DOCUMENTS

| | | | |
|---|---|---|---|
| 1,543,163 | 6/1925 | Johnson et al. | 418/57 |
| 1,659,107 | 2/1928 | Hvid | 418/57 |
| 1,850,394 | 3/1932 | Horawa | 418/57 |
| 4,580,957 | 4/1986 | Fickelscher et al. | 418/57 |
| 4,743,182 | 5/1988 | Schabert | 418/57 |

FOREIGN PATENT DOCUMENTS

| | | | |
|---|---|---|---|
| 30117 | 8/1922 | Denmark | 418/57 |
| 877052 | 5/1953 | Fed. Rep. of Germany | 418/63 |
| 3530436 | 2/1987 | Fed. Rep. of Germany . | |

*Primary Examiner*—Michael Koczo
*Attorney, Agent, or Firm*—Herbert L. Lerner; Laurence A. Greenberg

[57] ABSTRACT

A rotating piston compressor includes a cylinder. A thin-walled radially resilient piston contacts the cylinder at a given location and has a circular cross section, a surface facing the cylinder and a surface facing away from the cylinder. A rotationally symmetrical radial support engages the surface of the piston facing away from the cylinder. The support and the piston have local play therebetween at the given location. A drive shaft is connected to the support for eccentrically moving the support and the piston, the drive shaft having an eccentricity being greater than one-half the difference between the diameters of the cylinder and the piston.

40 Claims, 9 Drawing Sheets

ROTATING PISTON COMPRESSOR

SPECIFICATION:

The invention relates to a rotating piston compressor, or in general terms a rotary piston engine, having a cylinder in or about which a thin-walled, radially resilient piston with a circular cross section is move eccentrically by a drive shaft with the aid of a rotationally symmetrical radial support, the eccentricity being greater than one-half the difference between the diameters of the cylinder and the piston.

A rotationally symmetrical support according to German Published, Non-Prosecuted Application DE-OS No. 35 30 436, corresponding to allowed U.S. Pat. No. 898,696, filed Aug. 21, 1986, includes a thin-walled shell of durable elastic material, which is secured with one end to a drive shaft and which presses against the rotating piston with the other end. The shell acts as a spiral spring and is therefore deformed continuously during the rotation of the rotating piston. The flexing work associated with this causes losses and leads to heating, which is contrary to the intrinsically desired isothermic compression.

It is accordingly an object of the invention to provide a rotating piston compressor, which overcomes the herein-aforementioned disadvantages of the heretofore-known devices of this general type and which provides a rotationally symmetrical support which functions with low losses and nevertheless is as simple in construction as the prior art rotationally symmetrical support.

With the foregoing and other objects in view there is provided, in accordance with the invention, a rotating piston compressor, comprising a cylinder, a thin-walled radially resilient piston contacting said cylinder at a given location and having a circular cross section, a surface facing said cylinder and a surface facing away from said cylinder, a rotationally symmetrical radial support engaging said surface of said piston facing away from said cylinder, said support and said piston having local play therebetween at said given location, and a drive shaft connected to said support for eccentrically moving said support and said piston, said drive shaft having an eccentricity being greater than one-half the difference between the diameters of said cylinder and said piston According to the embodiment of the invention having the rotating piston located toward the inside, the force required for deforming the rotating piston is not transmitted as a compression force to the inside of the rotating piston, but instead is introduced as a tensile force from the side facing away from the sealing point, that is, the point of contact between the rotating piston and the cylinder, or in other words the side facing away from the cylinder. As a result, the rotating piston itself acts as an elastic spring in the form of a spiral spring. This results in less additional flexing work. Nevertheless, the construction remains quite simple.

The play between the rotating piston and the support at the aforementioned point of contact is at least 0.1 mm. Preferably it is in the range between 0.3 and 0.5 mm, especially during operation, in other words primarily at the temperature conditions that then prevail. The diameter play of the undeformed piston with respect to the support is also intended to be from 0.2 to 0.5 times the play at the point of contact with the cylinder. This play creates the necessary space for the elastic deformation of the rotating piston, which produces sealing between the piston and the cylinder On the other hand, the space is dimensioned as small as possible, so that the support firmly surrounds the flattened piston without play over a large portion of its circumference (from 180°to 270°) and secures it against vibration.

The support according to the invention can engage the end surface of the piston from the inside or the outside A seal is then suitably disposed at the point of engagement. This seal avoids gas losses which would otherwise be caused by the play provided in the support according to the invention.

A preferred embodiment of the invention provides that the piston is disposed inside the cylinder, and the support acts upon a compression belt introduced in a low-play manner into the piston The term "low-play" is intended to mean a value of 0.1 mm with respect to the diameter, measured at the undeformed rotationally symmetrical components A slight clamping effect, such as could be caused by a negative play, would also be tolerable. However, a pronounced clamping effect should be avoided, because in that case the two components nested in one another would cause energy losses due to mutual friction as a consequence of a constantly changing amount of flattening. Different temperatures and coefficients of thermal expansion should also be taken into account, as well as the local tangential compression strains that slightly upset the circumference of the compression belt In the final analysis, the object is to attain the desired "low-play" property for normal long-term operation.

The compression belt can also be firmly connected to the piston, or may form a component of the piston Otherwise friction losses can be reduced by means of a slide ring or a sliding film between the compression belt and the rotating piston.

The compression belt can also include a great number of individual clamps, which are suitably joined to the rotating piston, such as by being riveted A clamping element joined to the drive shaft can laterally encompass the compression belt. The clamping element is preferably divided crosswise relative to the piston axis, in order to enable adequate engagement between it and the compression belt without requiring complicated assembly. Wear-protection rings can be disposed on the sides of the compression belt.

The clamp holder may contain roller bearings and cooling air bores. This is also true in the case where a plurality of clamp bodies are distributed over the axial length of the piston. This last-mentioned kind of structure is particularly advantageous whenever the axial length of the rotating piston is substantially greater than the diameter, such as a length-to-diameter ratio of 3:1 or higher.

The invention can also be constructed in such a way that the piston surrounds the cylinder, In that case the support encompasses a tension belt slipped over the piston. The tension belt can encompass the piston with low play and can be clamped to a ring joined with the drive shaft, preferably with slide and wear-protection rings disposed in between. Alternatively, the tension belt can be constructed as a very flexible belt with very high play and can be provided with a tension pulley outside the rotating piston.

According to further features of the invention it can be provided that one compression belt is present in the vicinity of each end of the piston, each compression belt having a step oriented toward center on one side, that a clamping roller open on one side toward the end surfaces of the piston overlaps the step, and that the clamping roller is firmly connected to the drive shaft. With this kind of structure, the drive shaft and the clamping rollers provided on both ends produce a unit that can be preassembled and then can be introduced all at once into the cylinder. During the assembly, the drive shaft is fixed with the aid of the compression belts disposed in the vicinity of the ends of the pistons, the clamping rollers engaging the steps of the compression belts oriented toward the piston center, with axial play. On the other hand, during operation the axial guidance of the piston is taken over by the end surfaces of the cylinder.

The clamping roller may advantageously include a clamp bell and a deep-groove ball bearing, which is joined to both the drive shaft and the clamping bell by a press fit. The clamping bell may be a simple sheet-metal pressed or molded part and can have an inner collar for resting on the deep-groove ball bearing, resulting in an apparatus that is also fixed in the axial direction.

The compression belt can also be fixed in the axial direction on the piston. This can be done in such a way that the compression belt is fixed with the aid of a sealing ring holder associated with the end surfaces of the cylinder, which serves to seal off the piston at the end surfaces of the cylinder. The compression belt can be snap-fitted into a collar in the sealing ring holder, and the dissimilar resiliency of the sealing ring holder, which is made of plastic, and/or of the compression belt, which is made of metal, for instance bronze, can be exploited. The compression belt can also rest on a step of the piston.

The sealing ring holder can also protrude with an extension into an annular gap between the compression belt and the piston, so that the compression belt engages the piston indirectly. The sealing ring holder in this case acts as an intermediate shim and with a suitable selection of materials it can increase the slidability between the compression belt and the piston, thus making for smoother running and less wear.

The sealing ring holder advantageously encompasses a piston ring and a spring acting thereon in the axial direction. The term "encompasses" is intended to mean that the piston ring and the spring are retained in the sealing ring holder and constructed as a preassembled unit. The piston ring is suitably slit and is formed of plastic, carbon or the like.

The structure according to the invention results in a rotating piston compressor that is very quiet in operation. This property can be still further increased by providing that a middle region of the drive shaft is bent to serve as a counterweight. This exploits the fact that the support according to the invention is provided in the end regions of the piston. The shaft ends can also be bent in opposite directions, with the length of the oblique portion of the shaft being at most twice as large as the shaft diameter in the vicinity of the clamping roller, and a cylindrical shaft length of 70–100% of the width of the deep-groove ball bearing belonging to the clamping roller being located between the oblique shaft portion and the clamping roller. This embodiment is also easy to assemble for small piston diameters, as will be explained in further detail below.

The bent shaft ends are advantageously located in an outwardly oriented extension of the cylinder end walls This in fact makes it possible to substantially reduce the structural volume of the rotating piston compressor. The extension can have an inside collar for axial fixation of the drive shaft The deep-groove ball bearing can be fixed on the drive shaft with a circlip having a rated diameter which is smaller than the inside diameter of the deep-groove ball bearing but larger than the diameter of the bent region of the shaft ends. This has the advantage of only requiring the deep-groove ball bearing to be threaded-on over a short shaft length, and yet nevertheless avoiding strength-reducing fatigue by means of a groove required for the circlip. Cooling air bores can be provided in the clamping bells and in the end surfaces of the cylinder. These permit an intensive internal cooling, so that an approximately isothermic sealing can be obtained.

Because of the simple structure thereof, the invention can advantageously be made in such a way that two pistons rotating in opposite directions are disposed with parallel axes in two cylinder bores of a common housing, in which a common slide for separating the suction and compression chambers of the cylinder bores is located, and wherein the pistons are supported by common caps on the end surfaces of the housing through the clamping rollers. With so-called twin compressors of this kind, considerable compressor outputs can be attained in a small space. This is particularly advantageously accomplished by providing that a suction tube and a compression tube are disposed at opposite sides of the common housing, parallel to the rotating pistons. A compressor having a flat shape is thus obtained, which is easy to accommodate even when space is limited, such as in the engine compartment of a motor vehicle.

Other features which are considered as characteristic for the invention are set forth in the appended claims.

Although the invention is illustrated and described herein as embodied in a rotating piston compressor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 13 is a perspective view of a twin compressor; an

Figure 1:
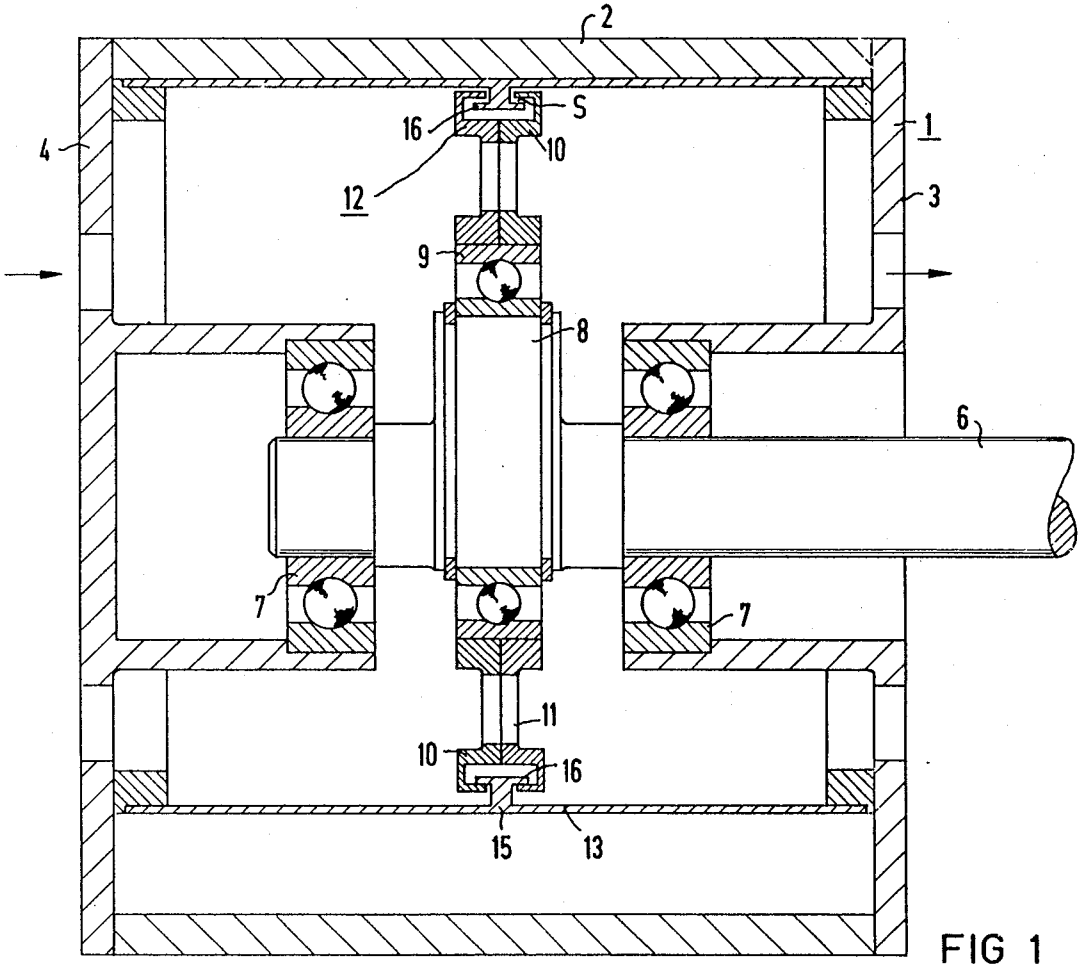
FIG. 1 is a diagrammatic, sectional view taken along the drive axis of a rotating piston compressor according to the invention.

Referring now to the figures of the drawings in detail and first, particularly, to FIG. 1 thereof, there is seen a rotating piston compressor having a housing or cylinder 1, which is formed of a cylindrical jacket body 2 and two flat side parts 3 and 4. A drive shaft 6 is supported by roller bearings 7 in the side parts 3 and 4. The drive shaft 6 has an eccentric element 8, on which a clamping element 10, which has cooling air bores 11, is secured by a ball bearing 9.

The clamping element 10 is part of a rotationally symmetrical support 12 of a cylindrical rotating piston 13, which has a smaller diameter than the cylinder 1. One-half the difference between the diameter of the rotating piston 13 and the cylinder 1 is less than the eccentricity of the eccentric element 8 (such as 4% less, which is 10.0 mm instead of 10.4 mm), so that the side of the rotating piston 13 facing toward the cylinder (which is the top as seen in FIG. 1), rests with a sealing force along a generatrix, surface line or jacket line along the cylinder wall, by means of elastic deformation.

The force required for deformation is exerted by the clamping element 10 in the form of tensile force upon the rotating piston 13 at the bottom of FIG. 1, through an annular region 15 firmly connected to the rotating piston 13. This region has a dovetail-like protrusion 16, which is constructed symmetrically. On the other hand, at the top of FIG. 1, play "S" between the clamping element 10 and the protrusion 16 produced because of the elastic flattening of the rotating piston 13 is clearly visible.

Figure 2:
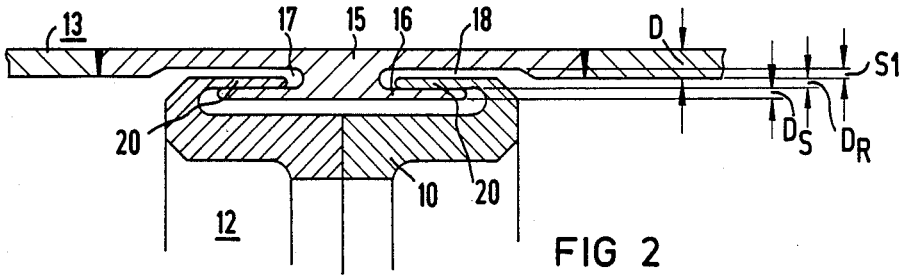
FIG. 2 is an enlarged, fragmentary, sectional view of a support of the rotating piston.

FIG. 2 shows these engagement conditions in detail. The clamping element 10 engages recesses 17 and 18 of the region 15 with a peripheral region 20 having a U-shaped cross section. A plurality of the clamping elements 10 may also be distributed over the axial length of the piston 13. The region 20 is provided on both sides of the two-part clamping element 10. In this manner, the support 12 exerts a tensile force upon the side or surface of the rotating piston 13 facing away from the cylinder, while at the point of contact between the rotating piston 13 and the cylinder 1, the play S is present between the dovetail 16 and the peripheral region 20. The amount of the play S must be smaller than the play S1 between the peripheral region 20 and the rotating piston 13 The following dimensions are typical: thickness D of the wall of the piston 13=1.2 mm, thickness $D_S$ of the dovetail 16=0.5 mm, thickness $D_R$ of the periphery 20=0.5 mm, and play S1 in the undeformed state =0.6 mm.

Figure 3:
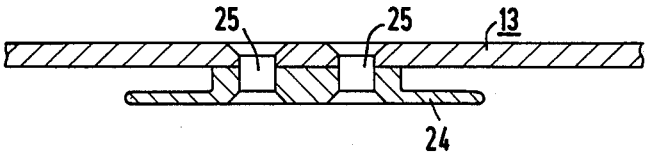
FIG. 3 is a view similar to FIG. 2 of a different embodiment of the support of the rotating piston.
Figure 4:
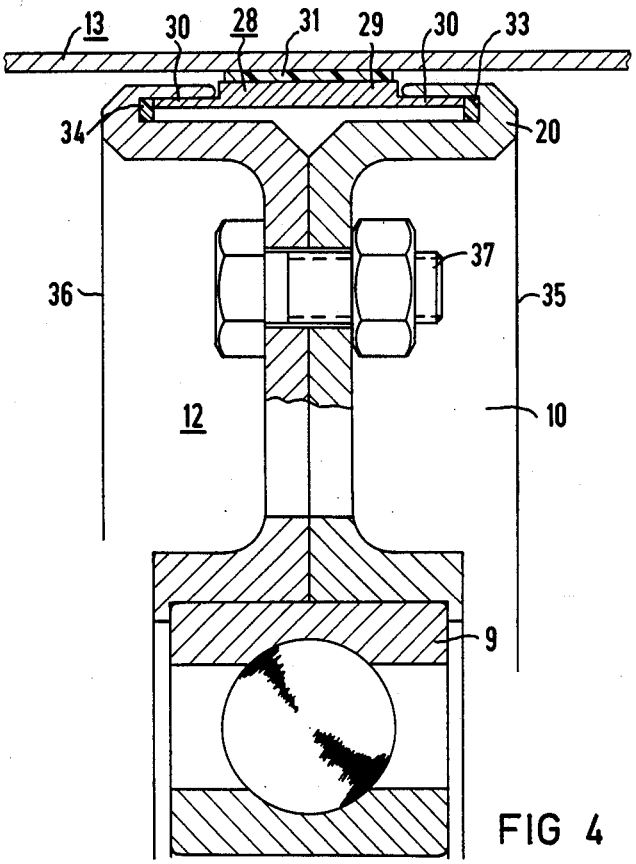
FIG. 4 is a fragmentary, cross-sectional view of a further embodiment of the support.

FIG. 3 shows that the dovetail-like structure of the piston 13 can also be attained with individual clamps 24, which are riveted onto the piston 13 with rivets or clamps 25. For instance, 36 clamps 24 having a width of 12 mm can be secured on the inside of one rotating piston 13, which has a diameter of 145 mm. The rivets may, for instance, be 2 mm thick In the embodiment of FIG. 4, the support 12 of the rotating piston 13 acts upon a compression belt or pressing ring 28, which has a cross section with a T-shaped profile visible in FIG. 4. A protrusion 29 of the compression belt 28 oriented toward the rotating piston, is at least twice as thick as two symmetrical flanges 30 and acts through a plastic slide ring 31 upon the inside of the rotating piston 13. The plastic ring 31 can be secured on the compression ring 28 or on the inside of the rotating piston 13. It may, for instance, be manufactured as a synthetic resin coating. The U-shaped periphery of the clamping element 10 encompasses two plastic rings 33 and 34, which provide a wear-protection layer that assures that the metal compression belt 28 can be guided in a wear-free manner by the metal clamping element 10 which is also metal and in particular is made of the same material as the compression belt. As shown in the drawing, the clamping element 10 is assembled from two symmetrical halves 35 and 36, which are joined with six screws 37 having a thread M5.

Figure 5:
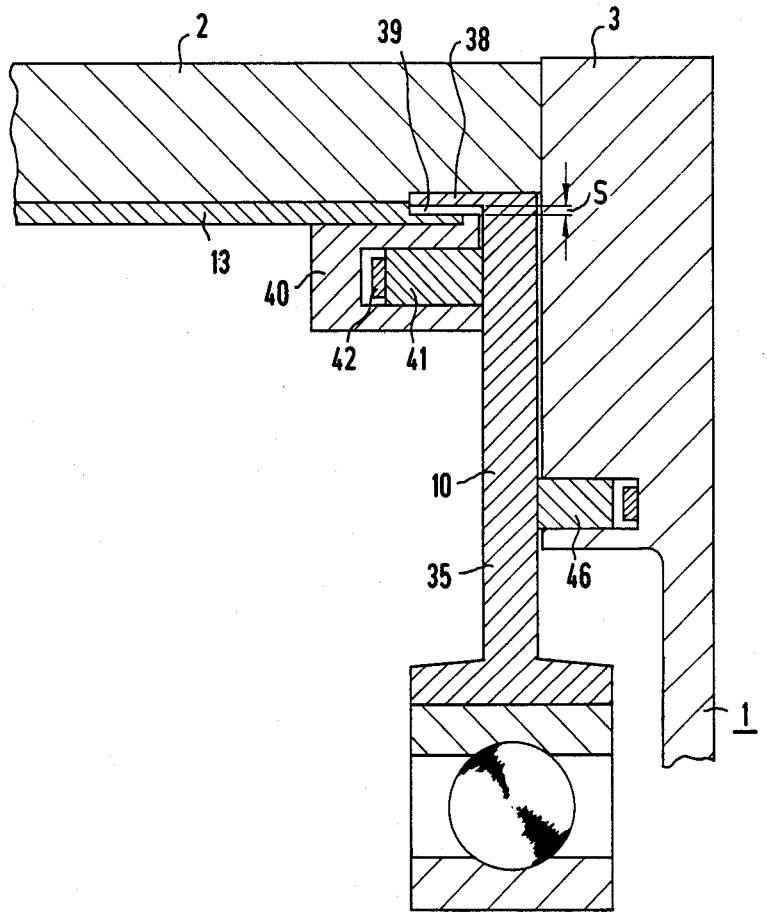
FIG. 5 is a fragmentary, sectional view of another embodiment of the vicinity of the end surface of a rotating piston compressor.

In the embodiment of FIG. 5, an asymmetrical clamping element 10 has a periphery 38 bent over at one side which fits over an end surface of the rotating piston 13 that has a recess 39 at that location. Once again a play S at the point of the circumference is shown between the rotating piston 13 at the recess 39 and the periphery 38. The circumference represents a section through the point of contact of the rotating piston 13 and the cylindrical jacket body 2. At the regions of the piston circumference which are not seen in the drawing (for instance over 240°), the clamping element 10 engages the recess 39 of the rotating piston 13 directly and without play and transmits the tensile force according to the invention. At the same time it stabilizes the rotating piston 13 from deformations that could be produced as a result of alternating lateral gas forces, and therefore prevents possible fluttering at high rpm.

A seal holder 40 is secured on the inside of the rotating piston 13 and a sealing ring 41 as well as a spring 42 are accommodated in the seal holder. The spring 42 is in the form of a wave or corrugated washer. The washer presses the sealing ring 41 in the axial direction against the clamping element 10, so that sealing is provided despite the play between the periphery 38 and the recess 39. Furthermore, a sealing ring 46 is also provided, which concentrically surrounds the drive shaft that is not shown at the bottom of FIG. 5.

Figure 6:
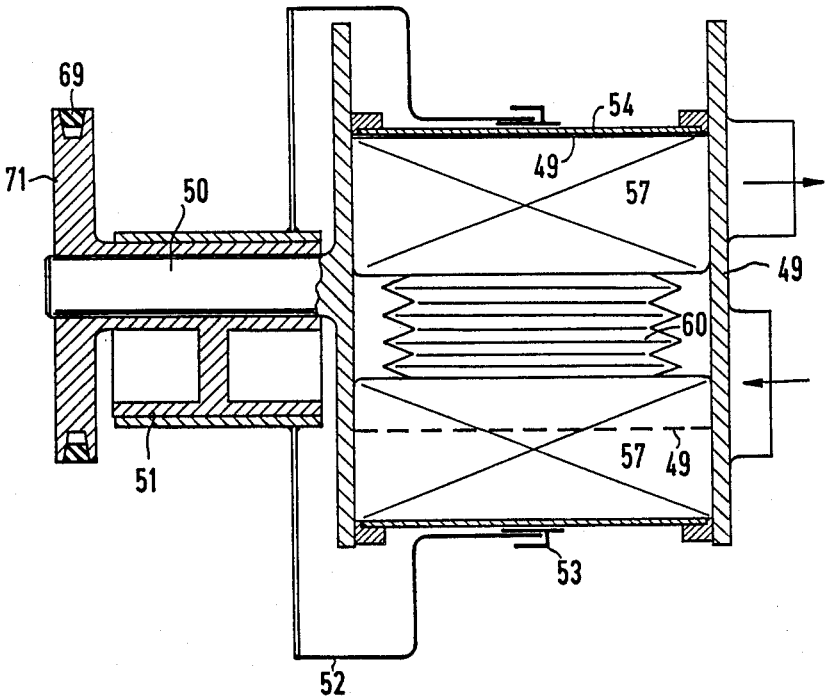
FIG. 6 is a sectional view parallel to the drive axis of a rotating piston compressor, in which the rotating piston includes the associated horizontal cylinder.

In the embodiment of FIG. 6, a rotating piston 54 is constructed as an inclusion in a stationary cylinder 49. A drive shaft 50 in this embodiment carries an eccentric element 51, on which an eccentric bell 52 is secured. The eccentric bell 52 engages a tension belt or pulling ring 53, which in turn is mounted with little play on the outside of the rotating piston 54. The rotating piston 54 is bidirectional in the illustrated embodiment. This is best seen from the cross section shown in FIG. 7.

Figure 7:
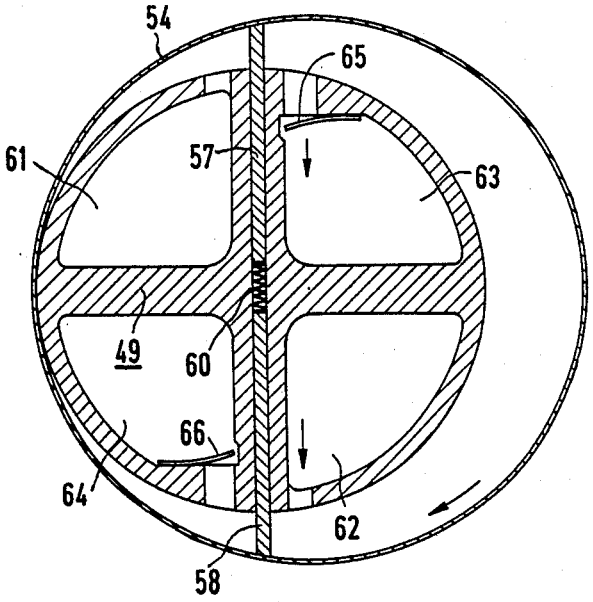
FIG. 7 is a cross-sectional view at right angles to the drive axis of the embodiment of FIG. 6.

According to FIG. 7, the stationary cylinder 49 contains two slides 57 and 58,.which are subject to the action of a spring 60. The slides each partition off an inner suction chamber 61, 62 from an inner compression chamber 63, 64, which have respective check valves 65, 66. In all of the embodiments, the variable volume working chambers are formed with the aid of an abutment which slides in the stationary housing, as shown in FIG. 2 of U.S. Pat. No. 4,743,182. In the embodiment of FIGS. 6 and 7, the rotating piston 54 is driven by a flexible belt 69. The belt 69 travels around a driving pulley 71 which drives the eccentric element 51, while the shaft 50 and the bell 52 remain stationary. The tension exerted upon the piston 54 can be predetermined with the belt 53. The tension belt 53 at the same time serves as a means of lateral stabilization of the rotating piston 54.

Figure 8:
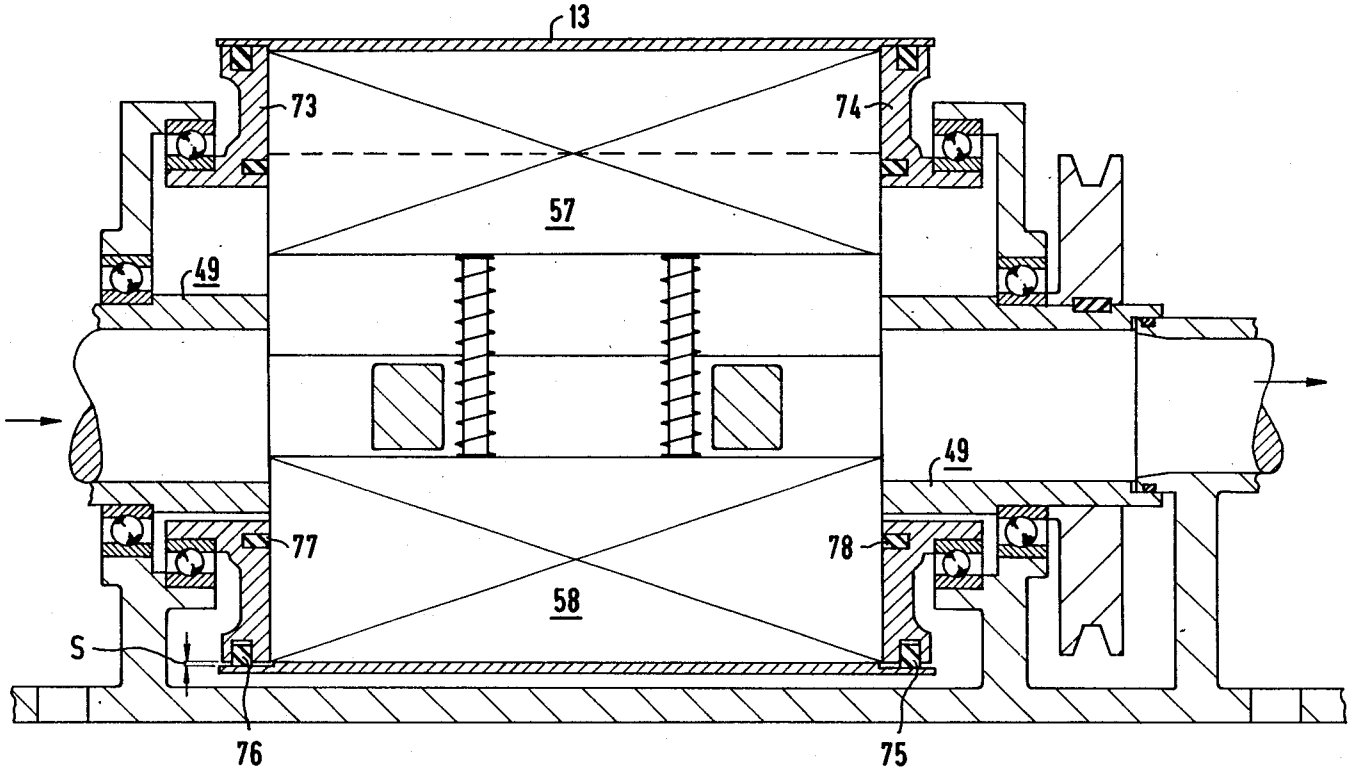
FIG. 8 is a fragmentary, longitudinal-sectional view of a further embodiment of the invention having a rotating cylinder.

In the embodiment of FIG. 8, the rotating piston 13 is also disposed on the outside of a rotating cylinder 49 equipped with two slides 57 and 58. The rotating piston 13 in this case is pressed onto the cylinder 49 by two eccentrically supported side disks 73 and 74. As a result, the rotating piston 13 rests without play upon the side disks 73, 74 at the top of FIG. 8. On the other hand, the play S is clearly visible at the bottom of FIG. 8, because at that location the cylinder 49 deforms the rotating piston 13 outward along its line or contact. The side disks 73, 74 have seals 75, 76 facing toward the rotating piston 13 and seals 77, 78 facing toward the cylinder 49.

The rotating piston compressor is intended primarily for supercharging automobile engines. In that case, it pumps air at negative pressure. However, it can also be used as a vacuum pump or for pumping other fluids.

Figure 9:
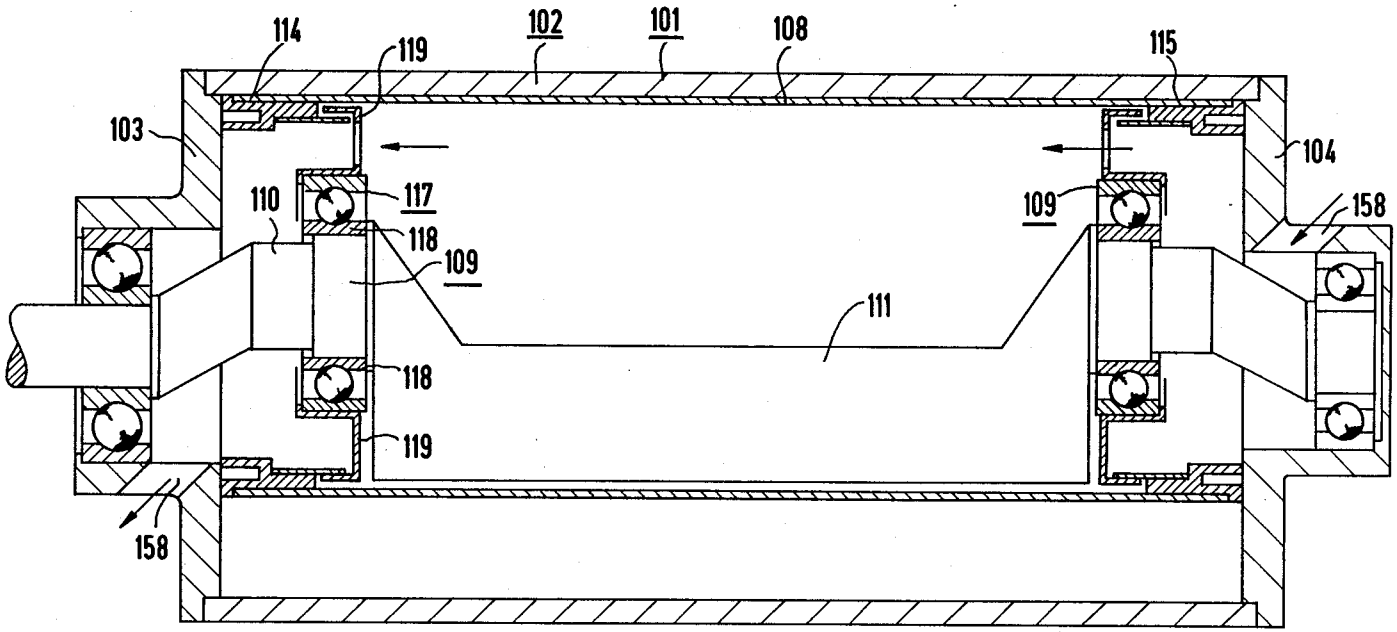
FIG. 9 is a fragmentary, sectional view along the housing axis of a rotating piston compressor according to the invention.

The rotating piston compressor 101 of FIG. 9 is intended for use in automobiles, in particular for supercharging four-stroke diesel engines. The compressor includes a cylindrical housing 102 having symmetrical cylinder covers 103 and 104 on the end surfaces thereof. The housing 102 and the cover 104 are made of aluminum.

A rotating piston 108 is seated in the cylinder 102. The rotating piston is in the form of a cylindrical tube made of special steel and is held by a drive shaft 110 with the aid of a support 109. The drive shaft 110 is a forged piece which is bent in a middle region 111 and which produces an eccentricity for the piston 108 with respect to the axis of the cylinder 102, that is greater than the difference between one-half the diameter of the cylinder 102 and the piston 108. Due to the oversize, the support point of the piston 108 becomes oval, producing a pressing force and correspondingly good internal sealing.

Figure 10:
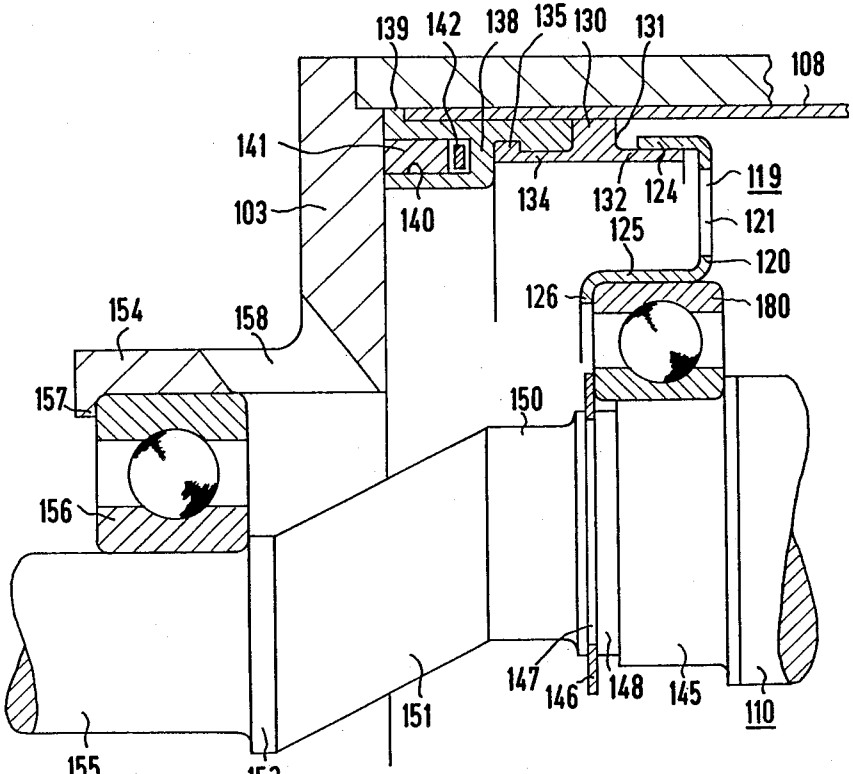
FIG. 10 is a fragmentary, enlarged, sectional view of the rotating piston compressor.

The support 109 which is provided in end regions 114 and 115 of the piston 108, is symmetrical and primarily includes a clamping roller 117. A deep-groove ball bearing 118 and a clamping bell 119 are part of the clamping roller 117. As seen in FIG. 10, the clamping bell is a pressed piece made of sheet metal having a radial region 120, which is provided with holes 121 for the passage of cooling air therethrough and two substantially axially oriented annular regions 124 and 125. The region 125 surrounds the ball bearing 118 and firmly holds it in the axial direction with an inwardly oriented collar 126. The region 124 overlaps a compression belt or pressing 130 made of bronze, which has a step 131 on the side thereof oriented toward the middle of the cylinder, producing an annular region 132 of reduced diameter. The clamping bell 119 is firmly connected to the deep-groove ball bearing by means of a press fit and the deep-groove ball bearing is firmly connected to the drive shaft 110 with a press fit. The ball bearing 118 is provided with sealing washers and is filled with grease.

The compression belt 130 has an outside diameter in the middle region thereof that is the same size as the inside diameter of the piston 108. The outwardly oriented portion is reduced in diameter, resulting in an annular element 134 having a collar 135. A sealing ring holder 138 made of plastic is snapped into place at the collar 135, engaging the piston end region 114 with a collar 139 through the end surface of the piston 108. The sealing ring holder 138 has an annular groove 140, into which a piston ring 141 made of plastic or carbon is inserted. The piston ring 141 is pressed by the action of a wave washer spring 142 against the wall surface of the cylinder, namely against the cover 103.

The deep-groove ball bearing 118, which is seated with a press fit upon a cylindrical region 145 of the drive shaft 110 is additionally held with a circlip 146, which is fitted into a groove 147 in a region 148 of reduced diameter. Adjoining the circlip 146 is a region 150 of the drive shaft 110, which once again is reduced in diameter. The rated diameter of the circlip 146 is 22 mm and is therefore less than the inside diameter of the roller bearing or the diameter of the cylindrical region 145, which is 25 mm, but greater than the outside diameter of an oblique shaft region 151, which is part of a bent shaft end 152.

As FIG. 10 clearly shows, the bent shaft end 152 protrudes into an outwardly oriented extension 154 of the cover 103. At the extension 154, a cylindrical region 155 is held with a ball bearing 156. The ball bearing 156 is fixed in the axial direction with an inwardly oriented collar 157 of the extension 154. After the insertion of the compression belt 130, the shaft 110 and the piston 108 can therefore be secured solely by the fact that the covers 103 and 104 are pushed onto the drive shaft 110 from both ends. Air bores 158 and the covers 103, 104, along with the holes, provide for a flow of cooling air through the piston 108 as represented by arrows.

Figure 11:
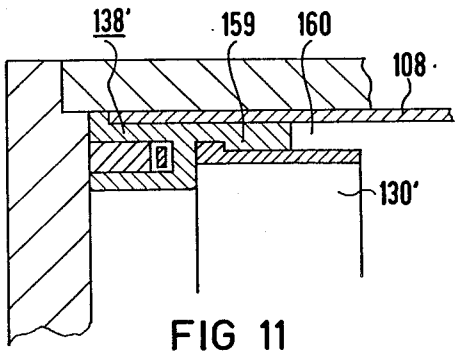
FIG. 11 is a fragmentary, enlarged, sectional view of a different sealing ring holder.

In the embodiment of FIG. 11, the compression belt 130' is not connected directly to the piston 108. Instead, a continuation 159 of a sealing ring holder 138', which fills an intermediate space 160 that is substantially larger than the wall thickness of the annular region 124 of the clamping bell 119, is disposed therebetween.

Figure 12:
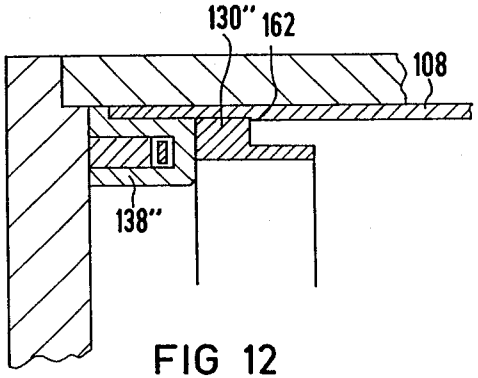
FIG. 12 is a view similar to FIG. 11 of another embodiment of the seal holder and compression belt.

In the embodiment of FIG. 12 it is shown that a compression belt 130'' is axially fixed between a step 162 on the inside of the piston 108 and a sealing ring holder 138'', which in turn is axially fixed with an outside collar 139 between the piston 108 and the cylinder cover 103.

Figure 13:
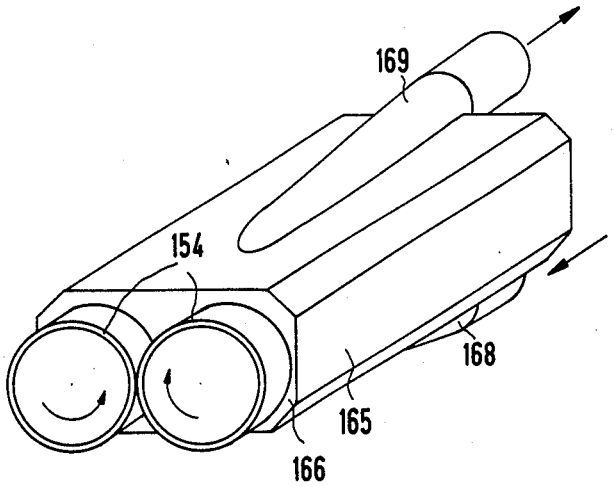
Figure 14:
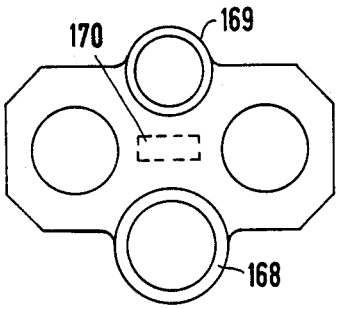
FIG. 14 is an elevational view of the rear cap on the end surface for the compressor of FIG. 13.

FIG. 13 shows that the rotating piston compressor according to the invention can advantageously be constructed in the form of a twin compressor, in which two cylinders are combined in one common housing 165. Parallel recesses for the rotating pistons which are not otherwise shown, are closed at the end surfaces with cover plates 166, which have parallel extensions 154 for receiving the shaft ends Parallel to the rotating pistons, an intake tube 168 and an outlet tube 169 are located on opposite ends of the housing 165. A separating slide 170 which cooperates with both pistons is shown in FIG. 14, between the inlet and outlet tubes The inlet tube (intake connector) 168 may have a larger diameter than the compression connector 169

An extraordinarily simple structure is obtained according to the invention. It is therefore possible with a twin compressor such as that fundamentally shown in FIG. 13, to attain high revolutions and correspondingly high compression outputs. At 4800 rpm and a volumetric efficiency of approximately 85%, an intake volume of 100 liters per second or 360 cubic meters per hour can be attained. The compressor has a length of approximately 300 mm and height of approximately 120 mm. The cylinder diameter is 100 mm, while the piston diameter is 80 mm. The pressure ratio is typically 2.0.

I claim:

1. Rotating piston compressor, comprising a cylinder, a thin-walled radially resilient piston contacting said cylinder at a given location and having a circular cross section, a surface facing said cylinder and a surface facing away from said cylinder, a rotationally symmetrical radial support engaging said surface of said piston facing away from said cylinder, said support and said piston having local play therebetween at said given location, and a drive shaft connected to said support for eccentrically moving said support and said piston, said drive shaft having an eccentricity being greater than one-half the difference between the diameters of said cylinder and said piston.

2. Rotating piston compressor according to claim 1, wherein said play at said given location is at least 0.1 mm.

3. Rotating piston compressor according to claim 1, wherein said play at said given location is 0.3–0.5 mm.

4. Rotating piston compressor according to claim 2, wherein said piston and said support have play therebetween in an undeformed state of said piston being from 0.2 to 0.5 times said play at said given location.

5. Rotating piston compressor according to claim 1, wherein said piston has an end surface engaged by said support at an engagement location.

6. Rotating piston compressor according to claim 5, including a seal disposed at said engagement location.

7. Rotating piston compressor according to claim 1, including a pressing ring inserted with little play into said piston with said support acting upon said pressing ring, said piston being disposed inside said cylinder.

8. Rotating piston compressor according to claim 7, wherein said pressing ring and said piston have play therebetween during normal operation being less than ±0.2 mm with respect to the diameters of said pressing ring and said piston in an undeformed state.

9. Rotating piston compressor according to claim 7, including a slide ring disposed between said pressing ring and said rotating piston.

10. Rotating piston compressor according to claim 7, wherein said pressing ring and said rotating piston are formed of metal and have substantially the same coefficient of thermal expansion.

11. Rotating piston compressor according to claim 7, wherein said pressing ring is firmly connected to said piston.

12. Rotating piston compressor according to claim 7, wherein said pressing ring is part of said piston.

13. Rotating piston compressor according to claim 7, wherein said pressing ring includes a multiplicity of individual clamps.

14. Rotating piston compressor according to claim 7, including a clamping element connected to said drive shaft encompassing said pressing ring on both sides.

15. Rotating piston compressor according to claim 14, wherein said clamping element is divided along a direction transverse to the axis of said piston.

16. Rotating piston compressor according to claim 14, wherein said pressing ring has sides, and including wear-protection rings disposed between said clamping element and said sides of said pressing ring.

17. Rotating piston compressor according to claim 14, wherein said clamping element includes roller bearings and has cooling air bores formed therein.

18. Rotating piston compressor according to claim 14, including at least one other clamping element, a plurality of said clamping elements being distributed over the axial length of said piston.

19. Rotating piston compressor according to claim 1, wherein said piston is disposed outside said cylinder, and including a pulling ring mounted on said piston and encompassed by said support.

20. Rotating piston compressor according to claim 19, wherein said pulling ring encompasses said piston with little play therebetween, and including a belt joined to said drive shaft and clamping said pulling ring.

21. Rotating piston compressor according to claim 20, including slide rings and wear-protection rings disposed between said pulling ring and said piston.

22. Rotating piston compressor according to claim 19, including at least one other pulling ring, said pulling rings being flexible and having very wide play, and at least one tension pulley for said rings outside said rotating piston.

23. Rotating piston compressor according to claim 1, wherein said piston has ends with end surfaces, and including pressing rings each being disposed in the vicinity of one of said ends of said piston, said pressing rings each having a step formed thereon with a side oriented toward the middle of said piston, and a clamping roller having a side being open toward said end surfaces of said piston, said clamping roller overlapping said step and being firmly connected to said drive shaft.

24. Rotating piston compressor according to claim 23, wherein said clamping roller includes a clamping bell and a deep-groove ball bearing, said ball bearing being connected to both said drive shaft and said clamping bell by means of a press fit.

25. Rotating piston compressor according to claim 24, wherein said clamping bell is a sheet-metal pressed piece and has an inner collar resting against said deep-groove ball bearing.

26. Rotating piston compressor according to claim 23, wherein said pressing rings are fixed in axial direction.

27. Rotating piston compressor according to claim 23, wherein said cylinder has end surfaces, and including a sealing ring holder associated with said end surfaces of said cylinder fixing said pressing rings in place.

28. Rotating piston compressor according to claim 27, wherein said piston has a step on which said compression belts rest.

29. Rotating piston compressor according to claim 27, wherein said pressing rings have a collar snapped into place in said sealing ring holder.

30. Rotating piston compressor according to claim 27, wherein said pressing rings and said piston have an annular gap therebetween, and said sealing ring holder has a continuation protruding into said annular gap producing indirect engagement of said pressing ring with said piston.

31. Rotating piston compressor according to claim 27, wherein said sealing ring holder has an outer collar overlapping one of said end surfaces of said piston.

32. Rotating piston compressor according to claim 27, including a piston ring and a spring acting upon said piston ring in axial direction, said sealing ring holder surrounding said piston ring and said spring.

33. Rotating piston compressor according to claim 24, wherein said drive shaft has a middle region being bent as a counterweight.

34. Rotating piston compressor according to claim 33, wherein said drive shaft has ends bent in opposite directions defining an oblique shaft portion having a length being at most twice as great as the diameter of said drive shaft in the vicinity of said clamping roller, and said drive shaft has a cylindrical shaft length between said oblique shaft portion and said clamping roller of from 70 to 100% of the width of said deep-groove ball bearing.

35. Rotating piston compressor according to claim 34, wherein said cylinder has end walls with an outwardly oriented extension, and said bent shaft ends are located in said outwardly oriented extension.

36. Rotating piston compressor according to claim 35, wherein said extension has an inner collar axially fixing said drive shaft in place.

37. Rotating piston compressor according to claim 24, including a circlip fixing said deep-groove ball bearing on said drive shaft, said circlip having a diameter smaller than the inside diameter of said deep groove-ball bearing but greater than the diameter of said bent shaft ends.

38. Rotating piston compressor according to claim 24, wherein said cylinder has covers, and said clamping bells and said covers have cooling air bores formed therein.

39. Rotating piston compressor according to claim 24, including another cylinder with a clamping roller, a housing having an end surface and having two cylinder bores formed therein defining said cylinders, said cylinder bores having suction and compression chambers, another piston, said pistons rotating in opposite directions with parallel axes in said cylinder bores, a common slide mounted in said housing for partitioning off said suction and compression chambers, and a common cover on said end surface of said housing supporting said pistons through said clamping rollers.

40. Rotating piston compressor according to claim 36, including a suction tube and a compression tube parallel to said rotating pistons on opposite sides of said housing.

* * * * *